United States Patent [19]

Poncy

[11] Patent Number: 4,753,705

[45] Date of Patent: Jun. 28, 1988

[54] METHOD OF MAKING AN ANTIDECUBITIS CUSHION

[75] Inventor: George W. Poncy, Singer Island, Fla.

[73] Assignee: Steridyne Corporation, Riviera Beach, Fla.

[21] Appl. No.: 20,720

[22] Filed: Mar. 2, 1987

Related U.S. Application Data

[62] Division of Ser. No. 711,102, Mar. 13, 1985, Pat. No. 4,672,700.

[51] Int. Cl.[4] ..... B32B 31/20

[52] U.S. Cl. ..... 156/292; 5/441; 5/442; 5/450; 156/308.4; 428/72

[58] Field of Search ..... 5/441, 442, 449–451; 156/292, 308.4; 428/72

[56] References Cited

U.S. PATENT DOCUMENTS 3,702,484 11/1972 Tobinick et al. ..... 5/451

4,483,030 11/1984 Flick et al. ..... 156/292 X

*Primary Examiner*—Robert A. Dawson

*Attorney, Agent, or Firm*—Lane and Aitken

[57] ABSTRACT

In a cushion designed to prevent decubitus, a bladder containing a liquid gel is mounted enclosed within a gussetted cover. The bladder is provided with extension panels on opposite sides thereof, which are fixed to the cover by sealing along seal lines where the gusset of the cover is joined by sealing to the top panel of the cover. Resilient foam slabs are positioned in the cover between the bladder and top panel of the cover and between the bladder and the bottom panel of the cover. The cushion is manufactured by mounting blanks for the gusset and the top and bottom panels of the cushion, as well as the bladder on a rectangular tubular electrode, by being wrapped and maintained around the top and bottom profile of the electrode. The electrode is then used to heat seal the gusset and panel blanks and bladder together in one sealing step along seal lines defined by the top and bottom profiles of the electrode.

4 Claims, 4 Drawing Sheets

METHOD OF MAKING AN ANTIDECUBITIS CUSHION

CROSS REFERENCE TO RELATED APPLICATIONS

This application is a divisional application of application Ser. No. 711,102 entitled "Antidecubitus Cushion" invented by George W. Poncy; filed Mar. 13, 1985 and now U.S. Pat. No. 4,672,700.

This invention relates to a cushion and more particularly to a cushion the type of which comprises a flexible bladder containing a fluid sandwiched by foamed resilient slabs and contained within an outer cover and which is designed particularly for the purpose of preventing decubitus.

Persons who must of necessity remain in a seated position for an extended period of time, either because of being handicapped and requiring a wheelchair, or because of their occupation, e.g. truck drivers, airline pilots, and receptionists, are susceptible to a condition known as decubitus. Decubitus arises from prolonged periods of pressure being applied to the skin and manifests itself in skin aggravations, which lead to sores. It has been proposed to prevent decubitus by means of a cushion, which provides a yielding support without compacting or bottoming out. Foamed resilient cushions, such as are made from latex or urethane provide some measure of relief. However, foam densities, which are high enough to provide adequate support fail to provide the needed resiliency to avoid skin aggravation. On the other hand, foamed densities which are low enough to provide adequate resiliency tend to bottom-out and thus, nullify the intended result.

It has been proposed that a flexible bladder partially filled with a liquid be employed in the cushion, either by itself or in conjunction with foamed resilient slabs to provide a constant accomodation of the shifting weight and pressure points exerted upon a sitting person's skin. The bladder is filled only partially so that when pressure is applied to one point in the bladder, the gel within the bladder can readily be displaced and the bladder can distribute the weight of the sitting person.

For the bladder to function, it must be maintained in a fixed position parallel to and sandwiched in between the foam slabs. Since the liquid filled bladder is flexible and not self-supporting, it will tend to fall to the bottom and fold upon itself especially when the cushion may be carried or placed in a vertical position. In the prior art, attempts have been made to prevent the bladder from collapsing by cementing the bladder to the sandwiching foam resilient slabs. While this method has proved to be moderately successful, in many instances the weight of the bladder has caused a shearing action upon the foam so that eventually the bladder has torn away from the slabs and collapsed. In accordance with another proposal, the bladder is provided with a flange extending around the perimeter of the bladder and this flange is then sealed to two cover sheets around all four sides of the bladder. The foam rubber slabs will sandwich the bladder inside the two cover sheets. This arrangement suffers from the problem that when the cover sheets are secured to the perimeter of the bladder, folds will necessarily occur in the edges of the cover sheets where they are joined together, thus preventing a secure strong seal from being made between the cover sheets and the bladder.

SUMMARY OF THE PRESENT INVENTION

In accordance with the present invention, a cushion is provided in which these problems with the prior art cushions are avoided. The cushion of the present invention comprises an outer cover including top and bottom panels and a gusset, which is joined to the top and bottom panels by heat seals extending around the perimeters of the panels. A liquid gel filled bladder is provided with extension panels on opposite ends of the bladder and these extension panels are sealed to the top panel and gusset where they are joined together. Resilient foam slabs are provided between the bladder and the top and bottom panels of the cover.

In the manufacture of the cushion, the gusset blank is first mounted on a rectangular electrode by being wrapped around the upwardly facing profile of the electrode and secured to the outside of the electrode by pins on the electrode extending through eyes in the gusset blank. One of the top or bottom panel blanks is then mounted on the electrode by the same pins. The electrode, with the gusset blank and panel blank mounted thereon, is then turned upside down, and the gusset blank, the other panel blank, and the extension panels of the bladder are wrapped around the upwardly facing profile of the electrode and secured to the outside of the electrode by pins on the electrode passing through eyes in the gusset blank, the panel blank, and bladder extension panels. The gusset blank, top and bottom panel blanks and extension panels are then electronically heat sealed together where they pass over the profiles of the electrode in one sealing step.

In one embodiment, the cover and bladder assembly is formed inside out. In this embodiment the gusset is provided with an opening, closed by a slide fastener. Upon the completion of the sealing step, the bladder is filled with gel and then the cover is turned right side out. The foam slabs are then inserted into the cover through the opening in the gusset between the bladder and the top and bottom panels. In an alternative embodiment in which the cushion is made right side out, the bladder is filled and is sandwiched by the foam panels prior to the sealing step.

It is important to note that the bladder is sealed to the cushion cover on only two sides of the bladder. This provides sufficient support to hold the bladder securely in place and prevent it from collapsing. Yet because the bladder is sealed to the cover on only two sides and because the extension panels, which eventually become sandwiched between one of the foam slabs and the gusset, permit the bladder to be sealed to the cover in the plane of the top or bottom panel with the liquid filled portion of the bladder located on a different plane in the middle of the cushion, the sealing step is carried out without any folds occurring where the electrode profile is impressed on the materials to be sealed, thus providing a long lasting structure.

Accordingly an object of the present invention is to provide an improved antidecubitus cushion.

A further object of the present invention is to provide an antidecubitus cushion with strong, long lasting seals between the bladder of the cushion and the cover of the cushion.

A further object of the present invention is to provide an antidecubitus cushion, which will maintain the integrity of its structure for a long period of wear and use.

A further object of the present invention is to provide an antidecubitus cushion, which can be easily manufactured.

A further object of the present invention is to provide an improved method of manufacturing an antidecubitus cushion.

Further objects and advantages of the present invention become readily apparent as the following detailed description of the invention unfolds and when taken in conjunction with the drawings.

DESCRIPTION OF SPECIFIC EMBODIMENTS

Figure 1:
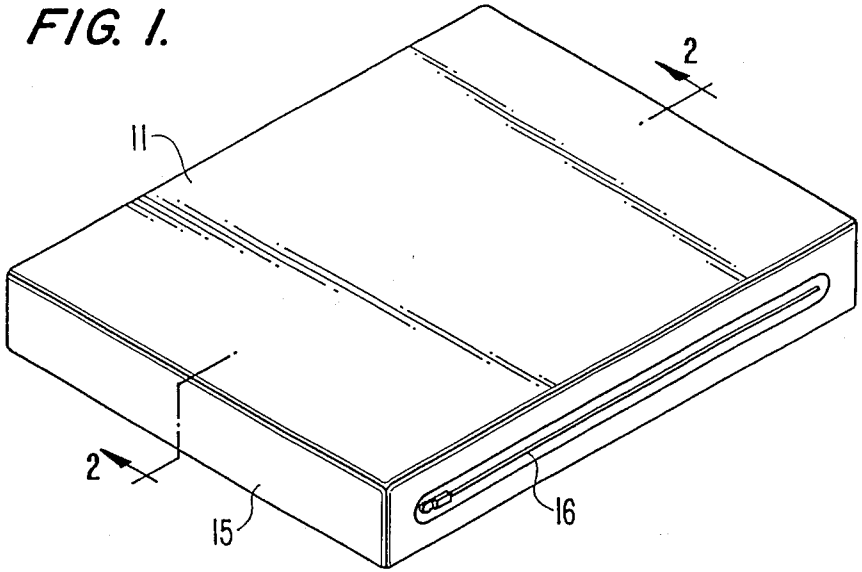
FIG. 1 is a perspective view of one embodiment of the cushion of the present invention.
Figure 2:
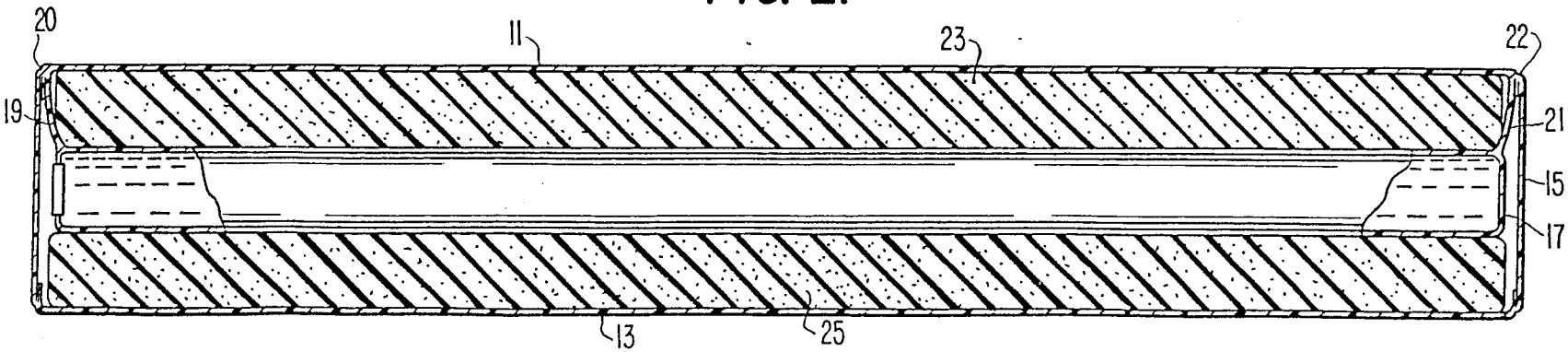
FIG. 2 is a sectional view in elevation of the cushion taken along the line 2—2 in FIG. 1.

As shown in FIGS. 1 and 2, the cushion of the present invention is in the shape of a rectangular prism and comprises an outer cover including a top rectangular panel 11, a bottom rectangular panel 13 and a gusset 15, which is sealed to the top panel 11 around the perimeter thereof and to the bottom panel 13 around the perimeter thereof. The gusset 15 is provided with an opening which is closed by a slide fastener 16, to provide access to the interior of the cover. Within the cover is a bladder 17, which is preferrably partly filled with a liquid gel. At the opposite ends of the bladder 17 are extension panels 19 and 21, which are sealed to the cover only along just two opposite edges of the top panel 11. The sealing of the extension panels 19 and 21 to the cover and the sealing of the gusset 15 to the top panel 11 is carried out in one sealing step as will be explained below. The extension panels, the gusset, and the top panel are sealed together along two common linear seals 20 and 22. Between the bladder 17 and the top panel 11 is an elastomeric foam slab 23 in the shape of a rectangular prism, and between the bladder 17 and the bottom panel 13 is an elastomeric foam slab 25 in the shape of a rectangular prism. The extension panels 19 and 21 are positioned between the ends of the slab 23 and the gusset 15.

Figure 3:
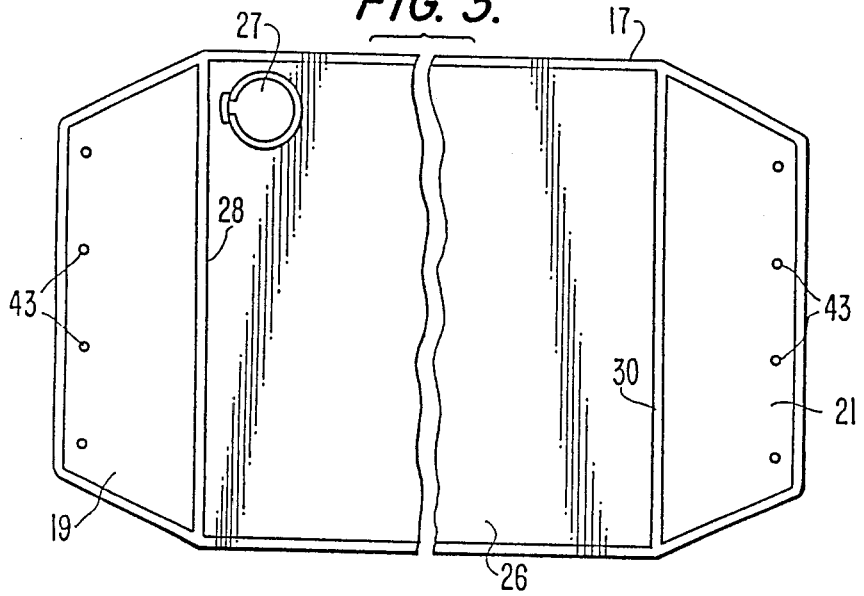
FIG. 3 is a plan view of the bladder employed in the cushion of the invention.

As shown in FIG. 3, the bladder 17 has a middle fillable section 26, which in the plan view has the shape of a rectangle. The two extension panels 19 and 21 in plan view have the shape of trapezoids. The bladder is formed from two sheets of water impervious heat sealable material, which are sealed together around the periphery thereof with two additional seals 28 and 30 joining the two sheets together separating the middle fillable section 26 from the extension panels 19 and 21. Fluid can be introduced into the fillable section 26 through an opening, which is closed by a valve 27.

Figure 4:
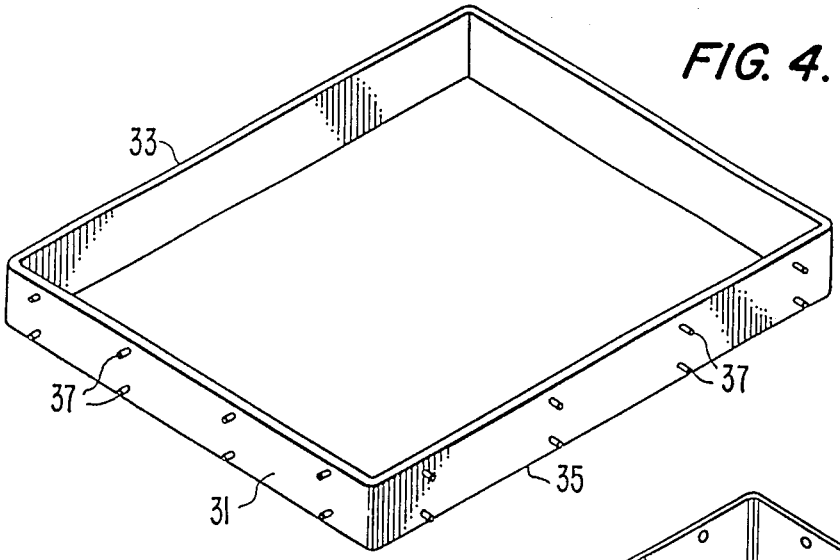
FIG. 4 is a perspective view of an electrode employed in the process of making the cushion of FIG. 1.
Figure 5:
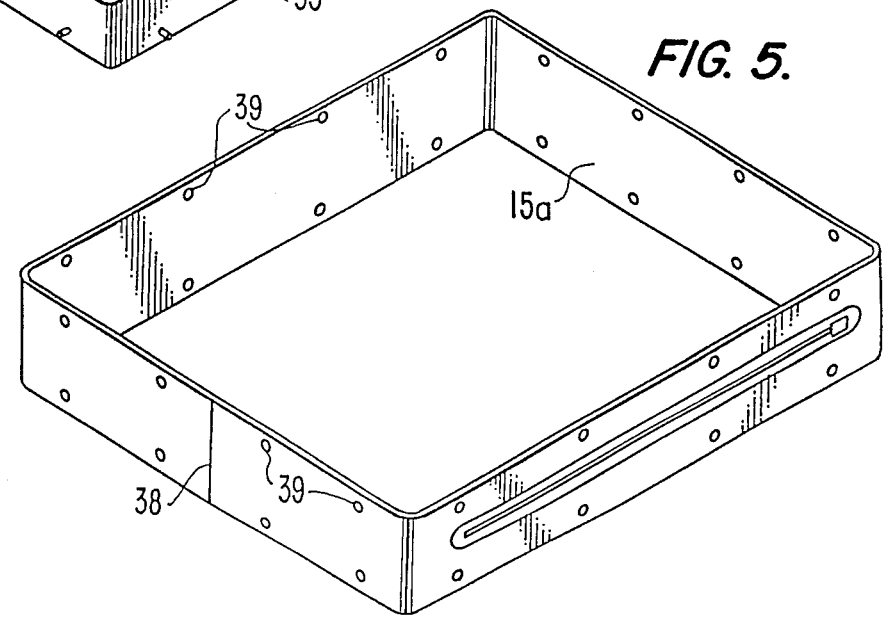
FIG. 5 is a perspective view of the gusset blank used for the gusset in the cushion of FIG. 1.
Figure 6:
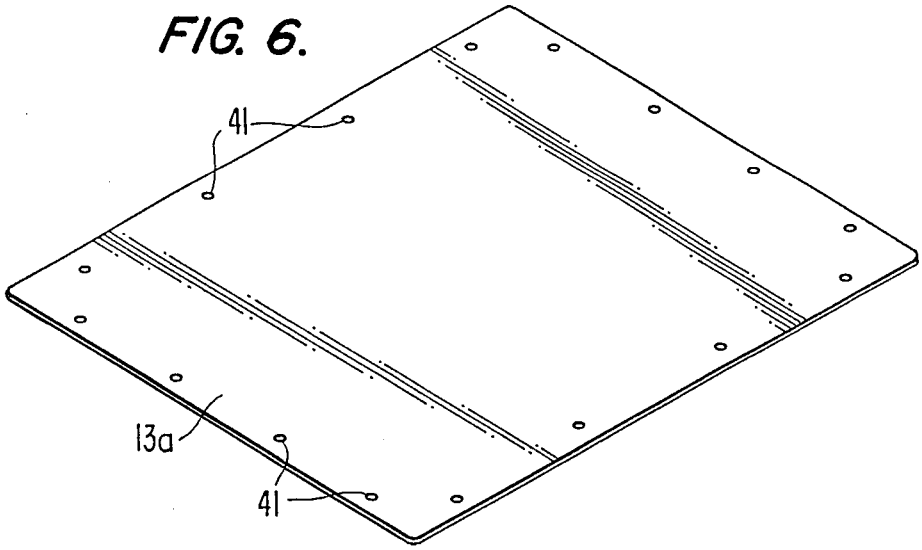
FIG. 6 is a perspective view of the bottom panel blank used for the bottom panel of the cushion of the present invention.
Figure 7:
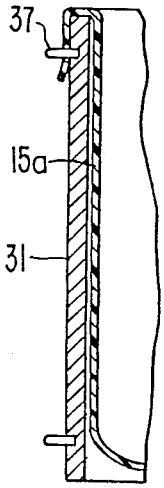
FIGS. 7, 8, and 9 are partial sectional views illustrating how the gusset blanks and top and bottom panel blanks are mounted on the electrode during the process of manufacturing the cushion of FIG. 1.
Figure 8:
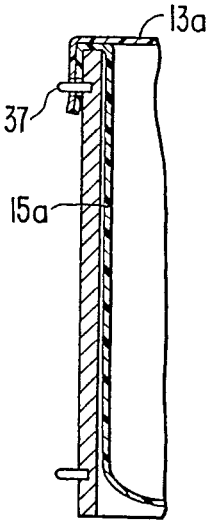

To manufacture the cushion, a rectangular electrode 31, as shown in FIG. 4, is employed. The electrode comprises four rectangular side walls and defines two rectangular profiles 33 and 35. Each side wall is provided with a series of pins 37 on the outside surface thereof near the end profiles 33 and 35. A blank 15*a* for the gusset is formed by sealing two ends of a strip of the cover material, which is heat sealable material, together along seal line 38 to form a blank, as shown in FIG. 5. The blank is provided with a series of eyes 39 near each edge of the gusset blank, each eye corresponding in position to the position of one of the pins 37 on the rectangular electrode 31. In the preferred embodiment, the gusset blank 15*a* is positioned within the electrode 31 in an inside out configuration and what is then the top edge of the gusset blank 15*a* is wrapped around what is then the top profile 33 of the electrode 31. The pins 37 are then inserted through the eyes 39 adjacent the edge of the gusset blank as shown in FIG. 7. The blank 13*a* for the bottom panel 13, which is shown in perspective in FIG. 6, is then placed over the top of the rectangular electrode with the inside surface of the blank 13*a* facing upwardly. A series of eyes 41 are provided around the periphery of the blank 13*a*. The blank 13*a* is wrapped over the profile 33 of the electrode and the pins 37 are inserted through the eyes 41 with the edge of the blank 13*a* lying over the edge of the gusset blank 15*a*, as shown in FIG. 8.

Figure 9:
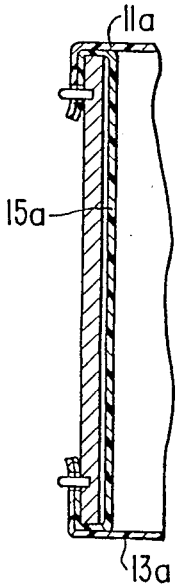

The electrode 31, with the gusset blank 15*a* and the bottom panel 13*a* pinned to the outside of the electrode, is then turned upside down. The other end of the gusset blank 15*a* is then wrapped around the profile on the opposite end of the electrode 31, which is now the upper profile, and the pins 37, near this profile of the electrode, are inserted through the eyes 39 near this edge of the gusset blank 15*a*. The blank 11*a* for the top panel 11, which is identical to the bottom panel blank 13*a*, is then positioned over the profile 35, which is now the upper profile of the electrode 31, with the inside surface of the blank 11*a* facing upward, and the edge of the blank 11*a* is wrapped over the outer edge of the electrode. The panel 11*a* is then pinned to the electrode by inserting the pins 37 through the corresponding eyes in the top panel blank 11*a*, as shown in FIG. 9, with the edge of the gusset panel 15*a* positioned between the electrode and the top panel blank 11*a*. The bladder is then mounted on the electrode by wrapping extension panels 19 and 21 over the top profile 35 of the electrode and pinning the extension panels 19 and 21 to opposite walls of the electrode by passing the pins 37 through eyes 43 provided in the extension panels 19 and 21.

The electrode with the gusset blank, the top and bottom panel blanks and the bladder are then centered on the bed of an electronic sealing press. The head of the sealing press, provided with a suitable pressure plate, is then brought to bear on the electrode 31. A radio frequency electronic generator is then fired to heat seal together, all the materials which lie over or under the opposing profiles 33 and 35 of the electrode 31. To insure that the side edges of the bladder, which are not to be sealed to the cover, do not become inadvertantly sealed to the cover, the dimension of the bladder parallel to the edges on which the panels 19 and 21 are situated is made 1" shorter than the corresponding dimension of the electrode 31. The dimension of the bladder and extension panels extending perpendicular to the edges on which the panels 19 and 21 are located will be quite a bit longer than the corresponding inside dimension of the electrode to accomodate for the length of the extension panels 19 and 21 extending vertically up around the end edges of the foam slab 23, as shown in FIG. 2. Accordingly to assure that a smooth plane of material of the bladder extension panels 19 and 21 is provided across the end edges of the electrode 31, the bladder is folded twice in the middle when it is pinned to the electrode 31 while the sealing process is carried out.

At the completion of the sealing process, the bladder and outer cover will be sealed together, but with the cover inside out and with the bladder at this time, on the outside of the cover. It is convenient at this time to partially fill the bladder with the gel. This is carried out by putting the chemical, which will form a gel with water, such as sodium acrylate, within the bladder, and then adding water to the bladder. An appropriate mixture of the water and the sodium acrylate would be one fluid ounce of sodium acrylate to one gallon of water. After filling the bladder, the valve of the bladder is then closed, and the bladder is then shaken vigorously to mix the chemical and water. The mixture is then let stand for about 15 minutes, whereupon the mixture will have fully gelled. Alternatively the gel may be made outside of the bladder and poured into the bladder. In order to provide the best support by the bladder 50 so that the gel within the bladder will be properly displaced when a person sits upon the cushion and the cushion conforms to the contour of the body of the person sitting on the cushion, the bladder is only partially filled. For best results, the bladder is filled to a point where it appears to be full, but not to the point where the bladder material is extended or stretched in any manner.

After the bladder has been filled and the gel formed within the bladder, the bladder is turned inside out through the opening closed by the slide fastener 16 in the gusset 15 and then the foam slabs 23 and 25 are inserted through the opening in the gusset between the bladder and the top and bottom panels 11 and 13.

Figure 10:
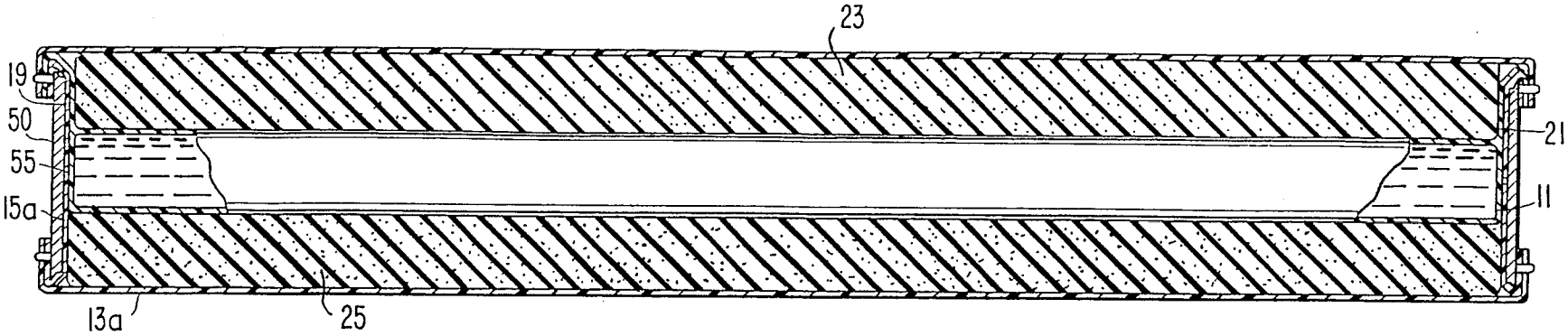
FIG. 10 is a sectional view in elevation of the cushion components mounted on electrode prior to sealing in accordance with another embodiment of the invention.
Figure 11:
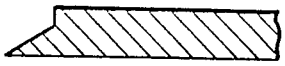
FIG. 11 is an enlarged sectional view of the electrode profile used in the embodiment of FIG. 10.

The embodiment of the invention illustrated in FIG. 10, is concerned with a cushion which will not need to be turned outside in when finished. In this embodiment, a tubular electrode 50 is used which is similar to that shown in FIG. 4, except that the two opposing profiles (top and bottom sealing surfaces) differ in their cross-sectional configuration. The profile instead being flat is bordered by a knife-edge running along the outside edge the entire profile, as best shown in the enlarged sectional view of the profile of FIG. 11. This type of electrode is widely known in the trade as a tear-seal electrode, which permits easy removal of the selvage of the materials sealed to each other along the electrode profile leaving a straight and smooth edge.

In the second embodiment the gusset portion has no slide fastener, since no turning outside-in will be necessary. Instead, to permit the escape of air when the cushion is compressed by the weight of a person upon sitting down, and entry of air when the compression is released, molded air vents 55 are sealed in the gusset panel.

In this second embodiment, the procedure for assembly of the cushion parts takes place before the sealing action occurs in that all of the inner cushion components are assembled within the electrode and therefore within the cushion outer covering materials as shown in FIG. 10. The procedure is as follows:

As before, the gusset blank **15*a* and one of the cushion panel blanks 13*a* is mounted on the electrode by means of the pins, but this time right side out. At this point, when the electrode is turned upside down so that the attached panel is on the bottom, the inside parts of the cushion are inserted within the electrode as follows. The bottom foam slab 25 is placed on top of the bottom cushion panel blank 13*a* and inside of the electrode cavity. Next, the gel-filled bladder 11 is placed on top of the slab 25, and then the bladder extension panels 19 and 21 are placed on top of the electrode profile and pinned in place as before. The foam slab 23 is then placed on the bladder 17 within the electrode 50. The top cushion panel blank 11*a* then placed, right side out, on top of the foam slab 23** and secured by pinning as before.

The entire load is then placed on the bed of an electronic heat sealing machine and a seal produced between all the materials pressed against the top and bottom electrode profiles. The finished cushion can then be unpinned from the electrode and the selvage outside the seal line torn away leaving a clean seal line around the top and bottom perimeters of the entire cushion.

While the perimeter edges of a tear-seal cushion do not present as neat an appearance as that of the first embodiment in which the seals are turned inside out, a certain economy results since the loading of the inside parts of the cushion within the electrode prior to sealing involves less labor than inserting the foam slabs into a cushion cover, which must be reversed before any loading can take place. Additionally, the cost of a slide fastener is eliminated.

Figure 12:
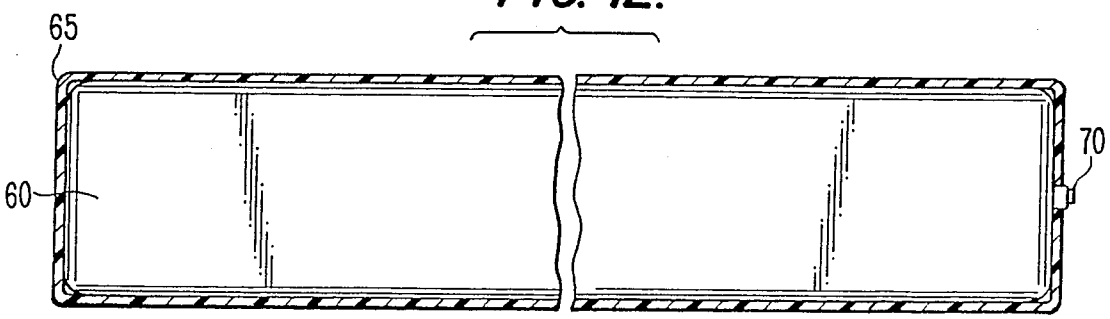
FIG. 12 is a partial sectional view of a third embodiment of the invention.

The third embodiment of the invention shown in FIG. 12, has certain advantages over those of the first and second described embodiments. This embodiment comprises an interior cushion 60, which is made in accordance with the procedures describe above with reference to FIGS. 10 and 11. The covering material which is used for the top and bottom panels as well as the gusset panel, need not be of a weight and finish which is required of an outside cushion cover, which needs to be able to withstand heavy use and wear. Instead, the covering material may be of a clear, soft vinyl, which imparts flexibility instead of resistance to wear. The interior cushion 60 of this embodiment has no slide fastener and with the exception of the small vents provided by the vent ports attached to the gusset, the inside of the cushion is sealed from outside exposure.

This interior cushion is then placed in a cover 65, which incorporates a slide fastener 70 along the gusset and which is assembled from top and bottom panels and a gusset panel as is described in a similar manner to that described with reference to FIGS. 7–9 except that no bladder is employed or required since the interior cushion 60 will already have a bladder secured within its confines.

The advantage of the cushion of FIG. 12 which is comprised, of an inner cushion 60 protected within outer tight seals, and an outer cushion cover 65 is that the outer cover can be replaced. Should the cushion cover be cut or damaged, the cushion may be reconstructed by simply purchasing a new cover and inserting the inner cushion through the slide fastener opening in the cover. If the cushion is wetted or heavily saturated with urine such as occurs with incontinent patients, the interior parts of the inner cushion, and especially the foam slabs are protected from wetting. Additionally, if the cushion is subjected to wetting over long periods of time and the cover is thus rendered unusable, the purchase of a new cover will restore the cushion to its original state. It should be noted that while in the first described embodiment, the slide fastener may be opened and the foam slabs removed to be used with a new cover (to replace a damaged one), the bladder is not recoverable since it would be sealed to the damaged cushion cover. Thus, the embodiment of FIG. 12 facilitates restoration of the damaged cushion by simply removing the inner cushion 60 in one piece and inserting it into a new cushion cover.

The above description is of preferred embodiments of the invention and modification may be made thereto without departing from the spirit and scope of the invention, which is defined in the appended claims.

What is claimed is:

1. A method of assembling the panels of the cover of a cushion with a bladder to be contained within the cover of said cushion, comprising providing an opening in one cover of said panels, sealing said panels together to assemble said cover inside out, sealing said bladder to said cover on the outside of said cover while said cover is inside out, and turning said cover and said bladder right side out through said opening.

2. A method of assembling panels into a cover for a gussetted cushion, comprising providing a tubular electrode having two opposed end surfaces adapted for heat sealing operation, folding a gusset blank of heat sealable material over both of said end surfaces of said electrode, mounting a top panel blank of heat sealable material on said electrode over one of said end surfaces and sandwiching said gusset blank between said top panel blank and said one of said end surfaces, mounting a bottom panel blank of heat sealable material on said electrode over the other one of said end surfaces and sandwiching said gusset blank between said bottom panel blank and said other one of said end surfaces, and simultaneously heat sealing said gusset blank to said top and bottom panel blanks along the end surfaces of said electrode.

3. A method, as recited in claim 2, wherein one of said panels is provided with an opening, said top and bottom panels and said gusset are arranged on said electrode so that when they are sealed together, the resulting cover is assembled inside out, and further comprising the step of turning the assembled cover right side out through said opening.

4. A method of assembling, as recited in claim 3, wherein said cushion is to contain a bladder within said cover, and further comprising sealing said bladder to said cover outside of said cover while said cover is inside out, said step of turning said cover right side out, bringing said bladder to the inside of said cover.

* * * * *